United States Patent [19]

Schmidt

[11] 4,058,209

[45] Nov. 15, 1977

[54] PAPER-CLIP DISPENSER

[75] Inventor: Karl Wilhelm Schmidt, Idar Oberstein, Germany

[73] Assignee: Gebruder Schmidt Metallwarenfabrik, Idar-Oberstein, Germany

[21] Appl. No.: 687,390

[22] Filed: May 17, 1976

[30] Foreign Application Priority Data

Jan. 15, 1976 Germany ..... 2601298

[51] Int. Cl.[2] ..... B65D 83/00; A45C 11/00

[52] U.S. Cl. ..... 206/350; 206/338; 206/818; 221/190; 221/212

[58] Field of Search ..... 206/350, 338, 340, 818; 221/212, 190

[56] References Cited

U.S. PATENT DOCUMENTS

| | | | |
|---|---|---|---|
| 2,544,114 | 3/1951 | Steinberg | 221/212 |
| 2,914,216 | 11/1959 | Gasparini | 221/190 |
| 3,130,862 | 4/1964 | Lachance | 221/190 |
| 3,704,991 | 12/1972 | Leedy | 206/350 |

*Primary Examiner*—William T. Dixson, Jr.
*Attorney, Agent, or Firm*—Montague & Ross

[57] ABSTRACT

A paper-clip dispenser has an upwardly open receptacle with a hole in its bottom through which a stem carrying a magnet passes. When the receptacle is lifted, the stem falls under its own weight or with the aid of a spring to bring the magnet of its upper end into a collection of paper clips at the bottom of the dispenser. When the dispenser is again placed upon the surface of a table or desk, the upper end of the stem is displaced upwardly to carry paper clips through the opening in the receptacle and enable them to be drawn off the magnet one at a time as required by the user.

8 Claims, 9 Drawing Figures

PAPER-CLIP DISPENSER

FIELD OF THE INVENTION

The present invention relates to a paper-clip dispenser of the type in which a magnet carries a plurality of paper clips which can be withdrawn from the magnet one at a time as required by the user.

BACKGROUND OF THE INVENTION

Paper-clip dispensers of the aforementioned type have been provided heretofore in the form of a receptacle or cup having a magnet disposed along its upper ring or mouth so that paper clips adhere to the magnetic surface and project upwardly through the mouth, enabling them to be gripped individually and withdrawn from the dispenser.

In order to permit the paper clips at the bottom of the cup to adhere to the magnetic surface after the cup has been partly emptied and the transfer of magnetic force from paper clips in contact with the magnet to paper clips therebelow is no longer effective, it is necessary for the user to reach into or tilt the cup to bring the remaining paper clips into a position in which they can be retained by the magnet. This arrangement is obviously inconvenient.

In another arrangement of the prior art, the magnet is formed at the upper end of a stem fixed in the receptacle and projecting above the opening or mouth thereof. In this embodiment the paper clips adhere to the stem and also can be removed one at a time. This system has the same disadvantage as the first-mentioned system in that when the supply of paper clips is partly depleted it is difficult to entrain additional paper clips into the region of the magnet without, for example, tilting the cup or attempting to reach into the latter.

In both cases it is necessary to shake or otherwise cause the paper clips to be raised to the magnetic surface.

Still another dispenser having the same disadvantage comprises a magnetic disk carried on a telescoping central member and biased by a spring upwardly away from the cup. The individual paper clips depend from the magnetic disk above the opening of the cup and can be removed individually. In order to enable the paper clips at the bottom of the cup to reach the magnet, the latter is pressed toward the mouth of the cup and the device is shaken.

In all of the embodiments of the prior art described, the paper clips must be brought to the magnetic surface by inconvenient manipulations or other procedures which are unsatisfactory.

OBJECT OF THE INVENTION

It is the principal object of the present invention to provide an improved paper-clip dispenser wherein the aforementioned disadvantages are obviated and which enables the paper clips to be delivered to the dispenser surface with greater facility than heretofore.

SUMMARY OF THE INVENTION

This object and others which will become apparent hereinafter are attained, in accordance with the present invention, in a paper-clip dispenser which comprises an upwardly open cup or other receptacle for a supply of the paper clips, the receptacle being provided with an opening in its bottom through which a stem passes movably, the stem carrying a permanent magnet at its upper end and, upon lifting of the receptacle, falling downwardly through the hole to bring the magnet into the proximity of the supply of paper clips at the bottom of the receptacle. When the receptacle is again placed upon a supporting surface, e.g. a table or desk top, the stem moves upwardly through the hole in the bottom of the receptacle to carry the paper clips engaged by its magnets into the proximity of the mouth of the latter. As in conventional systems, the paper clips may be withdrawn individually from the magnetic portion of the stem.

To prevent bunching of the paper clips on the magnet, the opening or mouth of the receptacle is so formed that it wipes gathered paper clips from the magnet so that only a single layer of the paper clips remains adherent to the magnetic surface. Excess paper clips are thus stripped from the magnetized portion of the stem by the edge of the opening or mouth of the receptacle.

The stem can be designed so that it falls through the hole in the bottom of the receptacle by its own weight or is biased downwardly by a spring. The bottom of the receptacle is preferably of a configuration causing paper clips to gather together around the stem, i.e. downwardly convergent. The stem itself, however, must be completely smooth to prevent jamming of paper clips between the stem and the housing or receptacle. So that the paper clips are delivered end first, rather than transversely, the upper end of the stem is upwardly convergent, e.g. conical or hemispherical or otherwise provided with a tip.

BRIEF DESCRIPTION OF THE DRAWING

The above and other objects, features and advantages of the present invention will become readily apparent from the following description, reference being made to the accompanying drawing in which.

SPECIFIC DESCRIPTION

Figure 1:
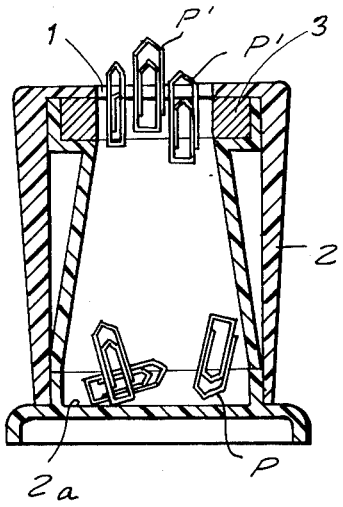
FIG. 1 PRIOR ART
FIG. 1 is a vertical cross-sectional view through a prior-art embodiment in which the magnet is disposed along the mouth of the receptacle.

FIG. 1 shows a prior-art arrangement in which the receptacle or cup 2 is formed with a circular opening 1 at its mouth, provided with a circular magnet 3. The paper clips P normally lie on the bottom 2*a* or floor of the receptacle and are brought up to the magnet by shaking the container or turning it over. The paper clips P which adhere to the magnet can be removed individually.

Figure 2:
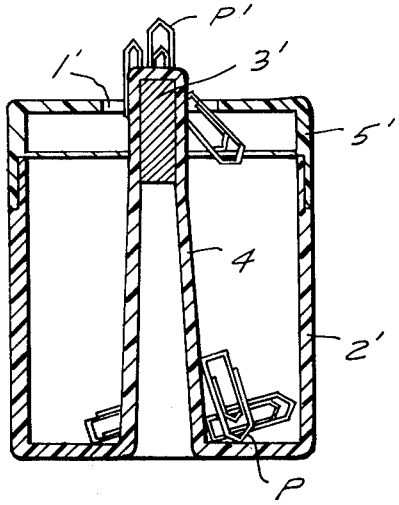
FIG. 2 PRIOR ART
FIG. 2 is a vertical sectional view through another prior-art embodiment in which the magnet is disposed on a fixed stem.

In the system of FIG. 2, in place of the annular magnet 3, a cylindrical magnet 3' is provided within a stem 4 which passes through an opening 1' in a cover 5' which is fitted onto the cylindrical receptacle 2'. In this embodiment as well, the paper clips P must be shaken to bring them to the mouth of the cup where they are retained (P') by the magnet 3' in the gap between the opening 1' and the magnet 3'. Frequently the paper clips jam in this gap and the introduction of paper clips is difficult since the cover 5' must be removed if the paper clips are not to be introduced individually into the narrow gap.

Figure 3:
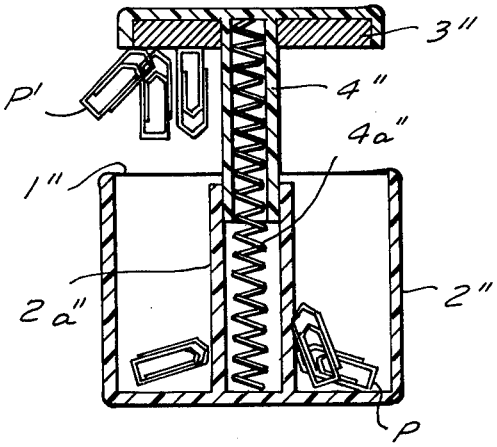
FIG. 3 PRIOR ART
FIG. 3 is a cross-section through a third prior-art device in which the magnet is a disk carried by a spring-biased telescopint stem.

The embodiment of FIG. 3 is also representative of the prior art. In this case the cup 2" has a cylindrical tube 2a" telescopingly receiving a stem 4" which carries a disk-shaped magnet 3" biased by a spring 4a" away from the mouth 1" of the receptacle. When the magnet 3" is pressed downwardly and the device is shaken, the paper clips P can be caused to jump up and bunch at P' at the underside of the magnet. This arrangement has the disadvantages of the systems of FIGS. 1 and 2 and the additional disadvantage that the paper clips P' depending from the magnet 3" readily fall off upon the least contact.

Figure 4:
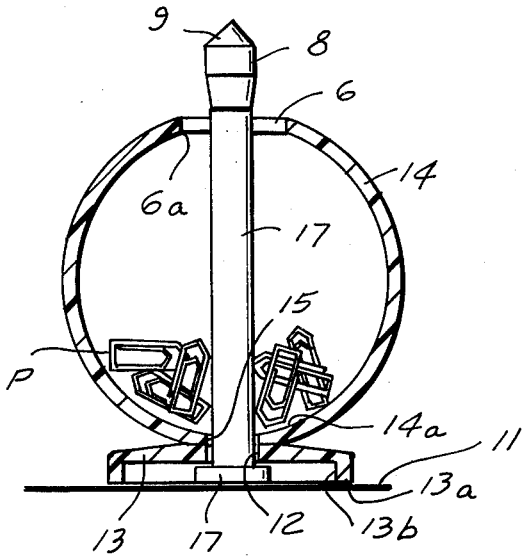
FIG. 4 is a vertical section through the dispenser of the present invention resting upon a surface after the last paper clip has been removed from its magnetic tip.
Figure 5:
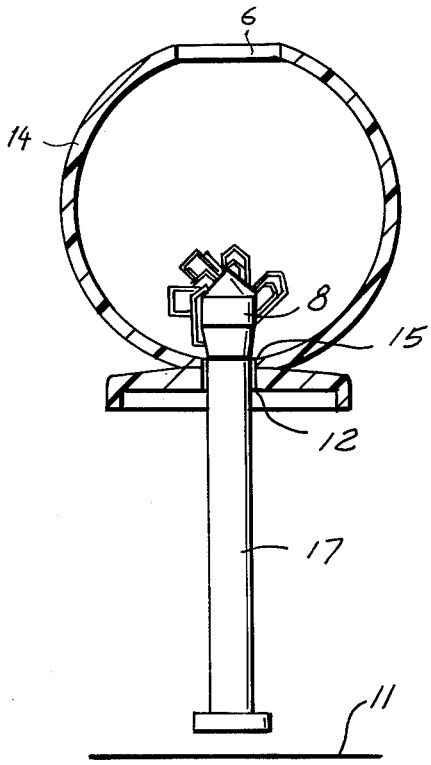
FIG. 5 is a view similar to FIG. 4 but showing the device after the receptacle has been raised.
Figure 6:
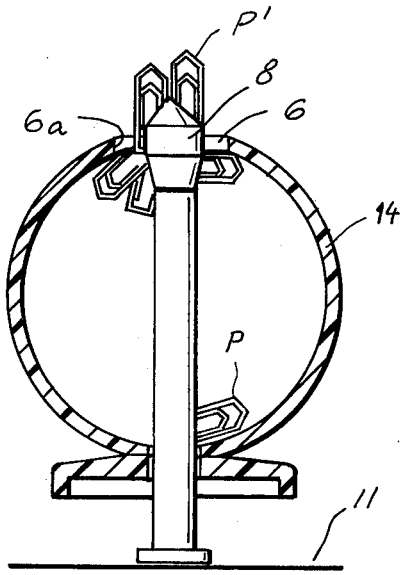
FIG. 6 is a vertical section showing the stripping action as the receptacle is lowered.
Figure 7:
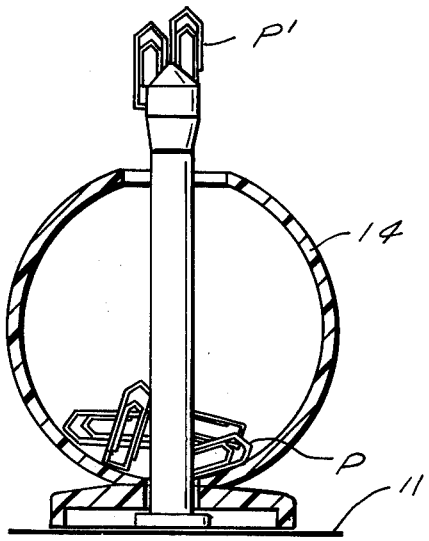
FIG. 7 is a vertical section showing the device in the position in which it is prepared to dispense additional paper clips.

In FIG. 4 I have shown the dispenser of the present invention which has also been illustrated in FIGS. 5 - 7 in other positions. In FIG. 4 the dispenser is shown to rest upon a surface 11 of a table or desk. The dispenser comprises a base 13 having a downwardly-extending flange 13a which forms a cavity 13b receiving the flange 17a of a stem 17 which is movable within a hole 12 of the base 13. Attached to the base 13 is a generally spherical receptacle 14 having an opening 15 aligned with the opening 12 in the base. Because of the sphericity of the receptacle 14, the floor 14a thereof adjoining the opening 15 converges downwardly and causes the paper clips P to bunch against the stem 17 which is smooth-surfaced to prevent jamming.

At its upper end, the stem 17 is formed with a tip 9 below which a magnet 8 is provided. The length of the stem 17 from the tip 9 to the flange 17a exceeds the diameter of the receptacle 14 so that the upper portion of the stem, including the magnet and the conical tip, extends through an opening 6 at the top of the receptacle 14. The inner edge 6a of the opening 6 serves to wipe excess paper clips from the magnet as has been illustrated in FIG. 6.

When the paper clips are depleted from the tip, the receptacle 14 is raised (FIG. 5), whereby the stem 17 falls by its own weight through the openings 12 and 15 to bring the magnet 8 into the collection of paper clips P at the bottom of the receptacle.

When the receptacle is lowered (FIG. 6), the stem rises upwardly so that the edge 6a wipes the excess paper clips from the magnet and leaves a layer P' thereof adherent to the magnet. When the receptacle is fully loaded, the excess paper clips P are again found on the floor of the receptacle 14.

Figure 4A:
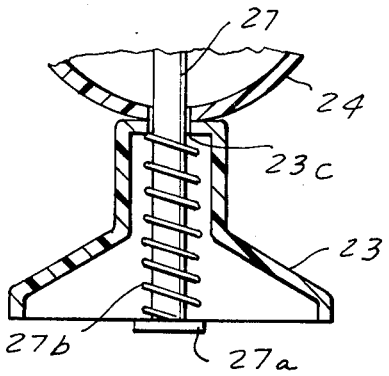
FIG. 4A is a fragmentary section illustrating another embodiment of the invention.

FIG. 4A shows that, in addition to its weight, the stem 27 can be biased downwardly by a spring 27b bearing against its flange 27a, the other end of the spring being seated against a wall 23c of the base 23 which carries the receptacle 24. Otherwise the structure is identical to that of FIGS. 4 - 7.

Figure 8:
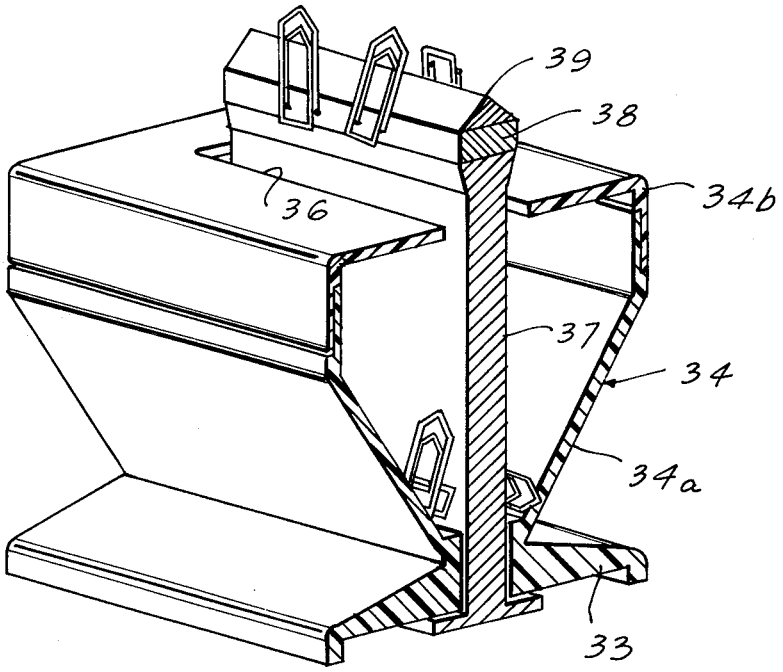
FIG. 8 is a perspective cross-section through another dispenser according to the invention.

In the embodiment of FIG. 8, the receptacle 34 is of prismatic configuration and has a cover 34b which is provided with an opening 36 in the form of a slot to pass the stem 37 which is in the form of a plate. The downwardly-converging walls 34a of the receptacle terminate in a base 33 as previously described. In this embodiment the tip 39 is formed as a prism above the bar magnet 38. When the receptacle 34 (or 14) is lifted to lower the respective magnet, the opening 36 (or 6) is cleared to receive additional paper clips. The embodiment of FIG. 8, of course, operates similarly to that of FIGS. 4 - 7.

I claim:

1. A paper-clip dispenser comprising an upwardly open receptacle having a mouth at the top and a hole in the bottom thereof, and a stem movably received in said hole and carrying a magnet at its upper end whereby elevation of said receptacle from a surface enables said stem to fall through said hole and bring said magnet into the proximity of paper clips contained in said receptacle and replacing of said receptacle on a surface causes said stem to raise in said receptacle and carry paper clips to the mouth thereof, said mouth having an edge positioned to wipe excess paper clips from said magnet, said stem extending through said mouth when said receptacle rests on said surface.

2. The dispenser defined in claim 1 wherein said stem falls through said opening solely by its own weight upon elevation of said receptacle.

3. The dispenser defined in claim 1, further comprising a spring raised between said receptacle and said stem biasing said stem downwardly relative to said receptacle.

4. The dispenser defined in claim 1 wherein said receptacle has walls converging downwardly toward its stem.

5. The dispenser defined in claim 1 wherein said stem is formed at its upper end with a converging tip.

6. The dispenser defined in claim 5 wherein said receptacle has a base formed with a downwardly open recess and said stem has a flange received in said recess.

7. The dispenser defined in claim 6 wherein said receptacle is generally spheroidal.

8. The dispenser defined in claim 6 wherein said receptacle is prismatic.

* * * * *